US011619005B2

(12) United States Patent
Swaine et al.

(10) Patent No.: US 11,619,005 B2
(45) Date of Patent: Apr. 4, 2023

(54) SEAMED PRESS FELT WITH MONOFILAMENT SEAM SUPPORT YARNS

(71) Applicant: AstenJohnson International, Inc., Charleston, SC (US)

(72) Inventors: Brent Swaine, Arnprior (CA); Gary Linstad, Appleton, WI (US); John Snead, Joanna, SC (US); John Xu, Kanata (CA); Rick Phillips, Greenville, SC (US)

(73) Assignee: AstenJohnson International, Inc., Charleston, SC (US)

( * ) Notice: Subject to any disclaimer, the term of this patent is extended or adjusted under 35 U.S.C. 154(b) by 0 days.

(21) Appl. No.: 17/262,536

(22) PCT Filed: Jul. 10, 2019

(86) PCT No.: PCT/US2019/041113

§ 371 (c)(1),
(2) Date: Jan. 22, 2021

(87) PCT Pub. No.: WO2020/027996

PCT Pub. Date: Feb. 6, 2020

(65) Prior Publication Data

US 2021/0292969 A1 Sep. 23, 2021

Related U.S. Application Data

(60) Provisional application No. 62/711,806, filed on Jul. 30, 2018.

(51) Int. Cl.
*D21F 7/10* (2006.01)
*D21F 7/08* (2006.01)

(52) U.S. Cl.
CPC ..... *D21F 7/10* (2013.01); *D21F 7/083* (2013.01)

(58) Field of Classification Search
CPC . D21F 1/00; D21F 1/12; D21F 1/0054; D21F 7/08; D21F 7/00; D21F 7/10; D21F 7/083
See application file for complete search history.

(56) References Cited

U.S. PATENT DOCUMENTS 3,815,645 A 6/1974 Codorniu
4,481,079 A * 11/1984 Dawes ..... D21F 1/0072 162/348

(Continued)

FOREIGN PATENT DOCUMENTS

| | | |
|---|---|---|
| CN | 101208473 | 6/2008 |
| EP | 0106132 | 4/1984 |
| EP | 1008682 | 6/2020 |

*Primary Examiner* — Eric Hug
*Assistant Examiner* — Matthew M Eslami
(74) *Attorney, Agent, or Firm* — Volpe Koenig

(57) ABSTRACT

A seamed press felt formed from a base fabric having a CD width and an MD length with two opposing MD ends that are joined to form a continuous belt. MD oriented yarns form uniform loops at the two opposing MD ends that are interdigitated to define a pintle channel extending across the CD width. CD oriented yarns are connected to the MD oriented yarns, in a woven or non-woven construction. Loop open spaces are located within the loops on each of the two opposing MD ends in a seam region, with the loop open spaces being defined between a last one of the CD yarns at each of the two opposing MD ends and the pintle channel. At least one CD monofilament support yarn is located in the loop open spaces on each of the two opposing MD ends. The at least one CD monofilament support yarn has a diameter that is at least 1.6 times a diameter of the CD oriented yarns. A pintle extends through the pintle channel to form a seam.

14 Claims, 14 Drawing Sheets

(56) References Cited

U.S. PATENT DOCUMENTS

| | | | | |
|---|---|---|---|---|
| 4,846,231 | A | 7/1989 | Penven | |
| 5,268,076 | A | 12/1993 | Best et al. | |
| 5,360,656 | A | 11/1994 | Rexfelt et al. | |
| 5,785,818 | A | 7/1998 | Fekete et al. | |
| 6,176,271 | B1 | 1/2001 | Sayers et al. | |
| 6,896,009 | B2 | 5/2005 | Ward | |
| 7,118,651 | B2 | 10/2006 | Aldrich | |
| 7,384,515 | B2 * | 6/2008 | Byfeldt | F16G 3/04 162/358.2 |
| 7,892,402 | B2 | 2/2011 | Hawes et al. | |
| 8,241,465 | B2 | 8/2012 | Crook | |
| 2004/0109960 | A1 * | 6/2004 | Rydin | D21F 7/10 428/33 |
| 2010/0043997 | A1 * | 2/2010 | Crook | D21F 7/10 162/358.1 |

* cited by examiner

STUFF YARN: FOUR 0.15mm 2x3 CABLED YARNS $D_{stuff}/D_{cd} = 0.5$

REPLACE THE STUFF YARNS WITH 1.75mm PU SUPPORT YARN $D_{support}/D_{cd} = 5.8$

ADD 1.0mm PU YARN AS SUPPORT YARNS $D_{support}/D_{cd} = 3.3$

TRIAL SAMPLE 3

CONTROL SAMPLE

TRIAL SAMPLE

CONTROL SAMPLE

SEAMED PRESS FELT WITH MONOFILAMENT SEAM SUPPORT YARNS

INCORPORATION BY REFERENCE

The following documents are incorporated herein by reference as if fully set forth: U.S. Provisional Patent Application No. 62/711,806, filed Jul. 30, 2018.

FIELD OF THE INVENTION

The invention generally concerns seamed press felts for use in the manufacture of paper and similar products in a papermaking or like machine. It is particularly concerned with seams for spirally wound, multiaxial press felts formed with four layers. The novel construction assists to reduce sheet marking at the seam.

BACKGROUND

The present invention concerns press felts for use in the press section of papermaking machines. In the manufacture of paper products, a stock slurry consisting of about 1% papermaking fibers and others solids dispersed in about 99% water is delivered at high speed and precision from a headbox slice onto a rapidly moving forming fabric, or between two forming fabrics, in the forming section of a papermaking machine. The stock is subjected to agitation and is dewatered by various means through the forming fabrics, leaving behind a loosely cohesive and wet web of fibers. This web is then transferred to the press section where a further portion of water is removed by mechanical means as the web, supported by one or more press felts, passes through at least one, and usually a series, of press nips where water is essentially squeezed from the nascent sheet and into the press felt. The water is accepted by the press felt and, ideally, does not return to the web. The resulting sheet is then passed to the dryer section which includes a series of rotatable dryer drums, or cans, that are heated by steam. The sheet is directed around and held in contact with the periphery of these drums by one or more dryer fabrics so that the majority of the remaining water is removed by evaporation.

Press felts play a critical role in the manufacture of paper products. The known press felts are produced in a wide variety of styles designed to meet the requirements of the papermaking machines on which they are installed, and the paper grades being manufactured. They are generally assembled using a woven or nonwoven base fabric structure into which is needled one and usually multiple layers of a fibrous nonwoven batt. The batt provides a smooth surface upon which the paper product is conveyed, acts as a reservoir to trap water expressed at the press nip, and provides a measure of resiliency to the press felt as it passes through the nip. The base fabrics are typically woven from monofilament, cabled monofilament, multifilament or similar multicomponent yarns; they may also be arranged as nonwoven planar arrays. The component yarns are usually comprised of an extruded polymeric resin, typically a polyamide.

The base fabrics may be of single layer or multilayer construction, or they may be formed from two or more layers which are laminated together. They may be woven endless, so that the resulting fabric resembles a tube with no seam; such fabrics must be prepared to the length and width of the machine for which they are intended, and must be slipped onto the press section in a manner similar to a sock. An example of such a fabric is provided in U.S. Pat. No. 7,118,651. In a variant modified endless weaving technique, the weft yarns are used to form seaming loops at the widthwise fabric edges during manufacture; when installed on the papermaking machine, these yarns will be oriented in the intended machine direction (MD) allowing the fabric to be joined by bringing the loops from each side together and inserting a pin, or pintle, through the resulting channel formed by the intermeshed loops. An example of a modified endless woven fabric may be found in U.S. Pat. No. 3,815,645. The base fabrics may also be flat woven, using one or more layers of warp or weft yarns; a seam is typically formed at each end allowing the fabric to be joined on the machine. An example of a flat woven base fabric may be found in U.S. Pat. No. 7,892,402. All of the above constructions require that the base fabric be woven to the full width and length of the machine for which they are intended.

In an effort to reduce manufacturing time and costs, so-called "multiaxial fabrics" have recently been introduced for the production of press felts. Multiaxial press felts are well known and are described in U.S. Pat. Nos. 5,360,656; 5,268,076; 5,785,818 and others. The base fabrics of these press felts are comprised of a plurality of spirally wound and edgewise joined turns of a material strip including at least machine direction (MD) oriented yarns. The material strip is usually a flat woven fabric which is narrower than the width of the intended base fabric of which it is a component; it has also been proposed to use nonwoven arrays of MD yarns as the material strip component. Regardless of whether the component is woven or nonwoven, during assembly each turn of the material strip is directed about two opposing rollers such that its component MD yarns are canted at a small angle that is from about 1° to about 8° to the intended MD of the finished fabric; see prior art FIG. 1. Each successive turn of the material strip is edgewise bonded to that laid adjacent to it so as to build up a continuous tube-like base fabric of desired width and length. When removed from the assembly rollers and laid flat, the tube has continuous top and bottom surfaces joined at cross-machine direction (CD) oriented fold regions at each of the two opposing ends; see prior art FIG. 2. The completed multiaxial base fabrics are typically one of a two, three or four layer construction comprising the top and bottom surfaces of the spirally wound continuous tube, and optionally at least one additional flat fabric layer, located either interior to the flattened tube, or on top of one or both exterior surfaces. The assembled base fabrics may later be provided with a seam to facilitate their installation on the machine for which they are intended.

FIG. 3 shows the two opposing edge regions of the spirally wound prior art double layer woven structure of FIG. 2 with a portion of the CD oriented yarns removed at the opposing fold regions. This exposes the MD oriented yarns of the structure so that the yarn loops may be used to form a seam in the fabric as illustrated in FIG. 4. This Figure shows a double layer fabric that has been seamed by intermeshing the yarn loops formed by the MD yarns at the fold region and inserting a pintle across the length of the channel thus provided.

For the seamed press felt, and particularly in the case of multiaxial fabric based press felts, there are several seam related issues. These include differences in the physical characteristics of the fabric in the seam area resulting in different resiliency and different air permeability, which can result in sheet break due to lower strength of the paper sheet at the seam mark, as well as marking of the finished paper. The seam region is thus usually recognized as the most critical area of the finished fabric.

One previously proposed solution was to insert so-called "stuffer yarns" into the base fabric adjacent the seam. These stuffer yarns are usually multicomponent yarns which, due to their larger surface area in comparison to monofilaments, offer greater opportunity for anchorage of the batt material during a needling process to provide more uniformity. However, the results here are inconsistent at best and still leave very perceptible marks on the finished sheet being processed/transported by the press felt.

It would be desirable to provide a press felt base fabric construction which improves upon the known sheet marking issues at the seam, particularly for multiaxial press felt constructions. The seam constructions provided herein address some or all of these issues.

SUMMARY

In one aspect, a seamed press felt is provided comprising a base fabric having a CD width and an MD length with two opposing MD ends that are joined to form a continuous belt. MD oriented yarns form uniform loops at the two opposing MD ends that are interdigitated to define a pintle channel extending across the CD width. CD oriented yarns are connected to the MD oriented yarns, using a woven or non-woven construction. Loop open spaces are located within the loops on each of the two opposing MD ends in a seam region, with the loop open spaces being defined between a last one of the CD yarns at each of the two opposing MD ends and the pintle channel. At least one CD monofilament support yarn is located in the loop open spaces on each of the two opposing MD ends. The at least one CD monofilament support yarn has a diameter that is at least 1.6 times a diameter of the CD oriented yarns. Preferably the number of CD monofilament support yarns in each of the loop open spaces is no more than 5, and more preferably, no more than 2. A pintle extends through the pintle channel to form a seam.

In one embodiment, a single one of the CD monofilament support yarns is used in the loop open spaces on each of the two opposing MD ends. The diameter of the CD monofilament support yarns have is at least 3 times a diameter of the CD oriented yarns. More preferably, the diameter of the CD monofilament support yarns is no more than 7 times a diameter of the CD oriented yarns.

In another embodiment, two of the CD monofilament support yarns are used in the loop open spaces on each of the two opposing MD ends. The diameter of the CD monofilament support yarns is at least 1.6 times a diameter of the CD oriented yarns. More preferably, the diameter of the CD monofilament support yarns is no more than 4 times a diameter of the CD oriented yarns.

In the preferred application for press felts, batt fibers are needled to the base fabric.

In the arrangements according to the invention, the seam quality is improved. One measure that is indicative of seam quality is an air permeability of the press felt across the seam region. In the embodiments according to the invention, this air permeability of the press felt across the seam region is within 15% of an air permeability of the press felt outside of the seam region. More preferably, it is within 10%.

In another aspect, the CD monofilament support yarns allow the pintle and the CD monofilament support yarns to fill at least 25% of a total area of the loops. More preferably, the filled area is 39% or more of the total area of the loops.

The seamed press felts can be made with a base fabric that is woven or non-woven.

Preferably, the CD monofilament support yarns have a diameter of at least 0.5 mm. In some embodiments, this can be a diameter of 1.0 mm or even 1.5 mm.

In embodiments where the press felt is a nonwoven multiaxial press felt, the base fabric may comprise a plurality of spirally wound turns of a first fabric structure, the first fabric structure including a first planar yarn array of the MD oriented yarns comprising single polymeric monofilaments arranged at a first density, at least two layers of a hot melt adhesive web having a first melting temperature, one of the layers of the hot melt adhesive located on each side of the first planar yarn array is used to attach an array of CD oriented yarns. Each adjacent one of the wound turns of the first fabric structure is oriented at an angle to the MD and is bonded to an adjacent turn to provide a flattened continuous double layer tube.

A preferred assembly method provides that the base fabric is collapsed so that it forms a flattened tube with two folded ends and the seam loops are located at the folded ends.

BRIEF DESCRIPTION OF THE DRAWINGS

The foregoing Summary and the following detailed description and claims will be best understood when read in conjunction with the drawings which show the presently preferred embodiments of the invention. In the drawings:

DETAILED DESCRIPTION

Figure 1:
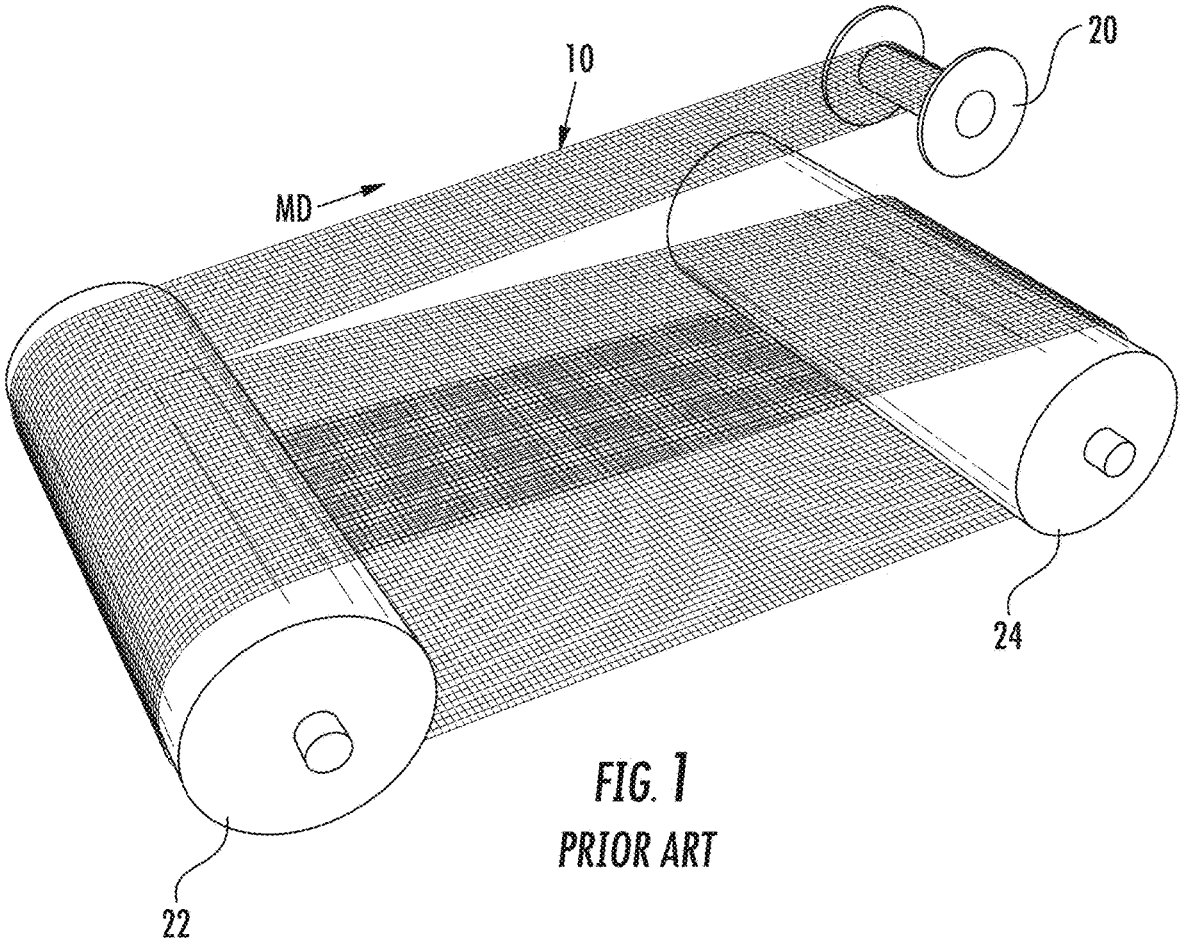
FIG. 1 PRIOR ART
FIG. 1 is an illustration showing a known spiral winding process in which a strip of relatively narrow fabric 10 is spirally wound from a feed source 20 between two opposed rolls 22, 24 to produce a desired width and length of base fabric. Each successive turn of strip 10 is bonded to that to which it is laid adjacent in the process to provide the base fabric.

Certain terminology is used in the following description for convenience only and is not limiting. The words "top," "bottom," "upper" and "lower" designate directions in the drawings to which reference is made. The words "interior" and "exterior" refer to directions within or outside of the two layers of the base fabric. A reference to a list of items that are cited as "at least one of a, b, or c" (where a, b, and c represent the items being listed) means any single one of the items a, b, or c, or combinations thereof. "A" or "an" refer to one or more of the item noted. "MD" refers to a machine direction in the papermaking machine from the headbox to the dryer section and is the longitudinal direction of the press felt. "CD" refers to the cross-machine direction, or a direction perpendicular to the machine direction in the plane of the fabric. The term "PS" refers to the paper side surface of the fabric, which is the surface upon which the paper product is carried through the papermaking machine. "MS" refers to the machine side of the fabric and is the surface opposite to the PS. Unless otherwise specified, the term "yarn" or "yarns" refers to a continuous length of either single or cabled polymeric monofilament such as would be used in the manufacture of the base fabrics, while the term "fiber" or "fibers" refers to relatively small diameter polymeric materials such as those commonly used in batt or scrim materials which fibers have a very small dtex (mass in grams per 10,000 meters of fiber). "Seam region" refers to the exposed yarn loops of the MD yarns at the CD fold areas at the opposing MD ends of the press felt. "Orthogonal" or "perpendicular" as used herein with respect to the CD and MD yarns means generally within about 85° to 95° based on the deviation from true perpendicular created by the spiral winding of the MD yarns in the first yarn array. The terms "left", "right", "up", "down" are used in relation to the drawings and have the meanings usually assigned. Additional definitions for terms used herein are as follows:

Additional Definitions

"Press felt base fabric": a woven or nonwoven assembly of yarns provided as an endless structure or continuous loop including two superimposed layers joined (when laid flat) at two opposing fold areas, including continuous MD yarns passing around the folds. The assemblies can take the form of: a) an endless woven structure, b) a modified endless woven structure, c) a flat woven fabric folded at two locations to provide a double layer assembly, d) a fabric formed according to a multiaxial assembly process, or e) a nonwoven structure assembled to provide any of the previous assemblies. The present invention is applicable to all of the above, but it is particularly suitable for use in both woven and nonwoven multiaxial base fabric constructions. All of the base fabrics, with the possible exception of those which are endless woven, are post processed to provide seam loops formed by the MD oriented component yarns allowing the fabric to be joined and thus rendered endless. These base fabrics provide the finished press felt with the physical properties (strength, void volume, resiliency) necessary for it to survive the rigors of the machine environment in which it will be used, while providing a rugged carrier for the batt fibers.

Figure 2:
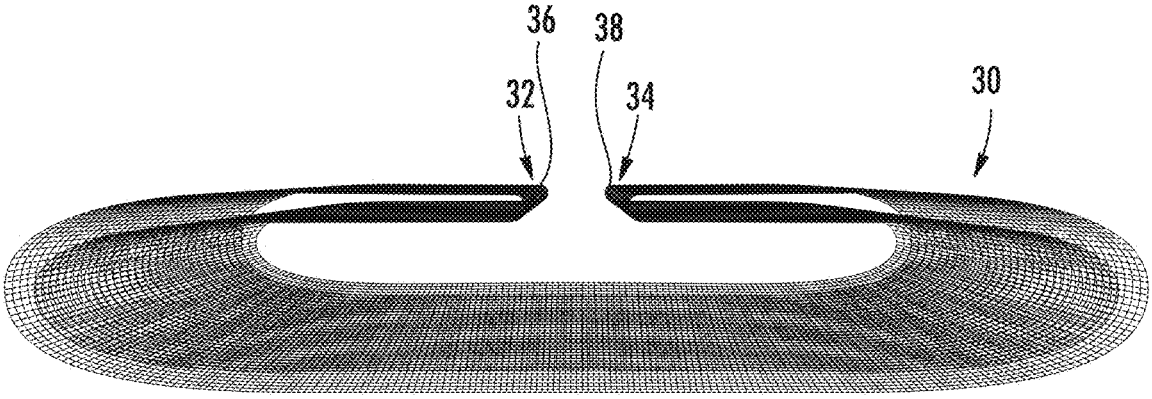
FIG. 2 PRIOR ART
FIG. 2 is a view of a continuous tube-like base fabric 30 including opposing fold regions 32 and 34; fabric 30 may be made from successive turns of the narrow fabric 10 in the manner illustrated in FIG. 1, or it may be produced by a modified endless weaving process, a flat weaving process where opposing ends of the flat woven cloth are joined to provide a continuous tube, or it may be a nonwoven cohesive assembly of yarns oriented in the length direction around the tube.
Figure 3:
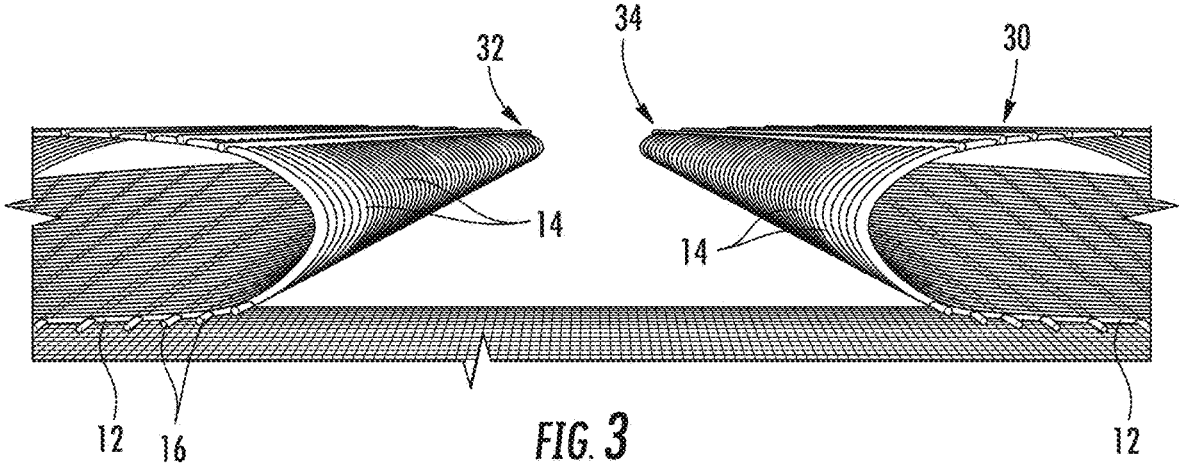
FIG. 3 PRIOR ART
FIG. 3 is an enlargement of the two folded edge regions 32, 34 of the base fabric 30 presented in FIG. 2 which form the seam region in the prior art fabrics shown in FIGS. 1 and 2.
Figure 4:
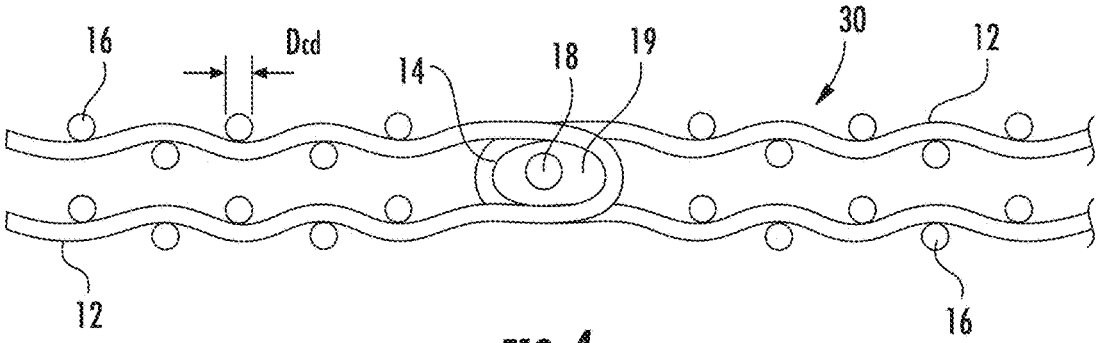
FIG. 4 PRIOR ART
FIG. 4 is a schematic illustration of the seam region in a prior art base fabric such as presented in FIGS. 1 to 3 including a pintle 18 to join the seam regions of the folded ends 32, 34. This is shown prior to needling of one or more batt layers to the base fabric 30.

Referring to FIGS. 1-4, one construction of a press felt base fabric 30 in accordance with the prior art is shown, in this case a multiaxial construction. FIG. 1 shows a strip of material, which can be woven or non-woven and including MD oriented yarns 12 and CD oriented yarns 16, being unwound from a source 20 and wrapped around two rolls 22, 24. The longitudinal edges of the strip are joined together to form a fabric tube. FIG. 2 shows the fabric tube collapsed to form the press felt base fabric 30 having two fold regions 32, 34, that define the fabric ends 36, 38. As shown in FIG. 3, continuous ones of the MD yarns 12 form loops 14 at each of the fold regions 32, 34 at the fabric ends 36, 38 that can be intermeshed in a known manner to form a pintle channel 19 in which a pintle 18 is inserted, as shown in FIG. 4, to form an endless base fabric 30.

In the case of a multiaxial press felt base fabric 30, as well as other double layer base fabrics, the double layer formed by collapsing the fabric tube is connected together in a needling process in which one or more layers of a nonwoven fibrous batt material 28 (shown in FIG. 5) are attached (shown in FIG. 5) to the base fabric 30 in a needling process to form the press felt 31. It is frequently necessary to insert special yarns, commonly referred to as "stuffer yarns" which are small multifilament yarns, to allow better engagement and entanglement with the batt fibers, adjacent the seam region to enable secure attachment of the batt material 28. The fibrous batt material 28 is typically a selected mixture of polyamide fibers such as is known in the art. It is also possible that a portion of these fibers may be bi-component in nature and include an adhesive component which, during subsequent fabric processing, melts to provide improved surface fiber retention and smoothness to the resulting fabric.

After the needling process, it is necessary to again free the yarn loops 14 of excess batt fiber so that the seam region can accommodate the pintle 18 or similar retaining means that is passed through the loops 14 as the finished fabric is joined on the machine for which it is intended. The batt fiber material 28 in this fold region is typically cut and brushed back to form a flap of nonwoven material which is laid back over and reattached at the seam region to minimize any discontinuity there.

The needled press felt 31 is then subjected to heatsetting and various other known finishing steps so as to stabilize it. Following these steps, the finished nonwoven press felt is ready for installation in the press section of a paper machine. The press felt 31 may be installed by passing it through the press section at slow speed while attached to one end of the previous press felt, bringing together the opposed seam regions, intermeshing the loops 14 formed by the MD yarns 12 at the fold regions, and then inserting the pintle 18 or similar joining wire or device through the pintle channel 19 provided at the seam region to close the fabric 31.

Figure 5:
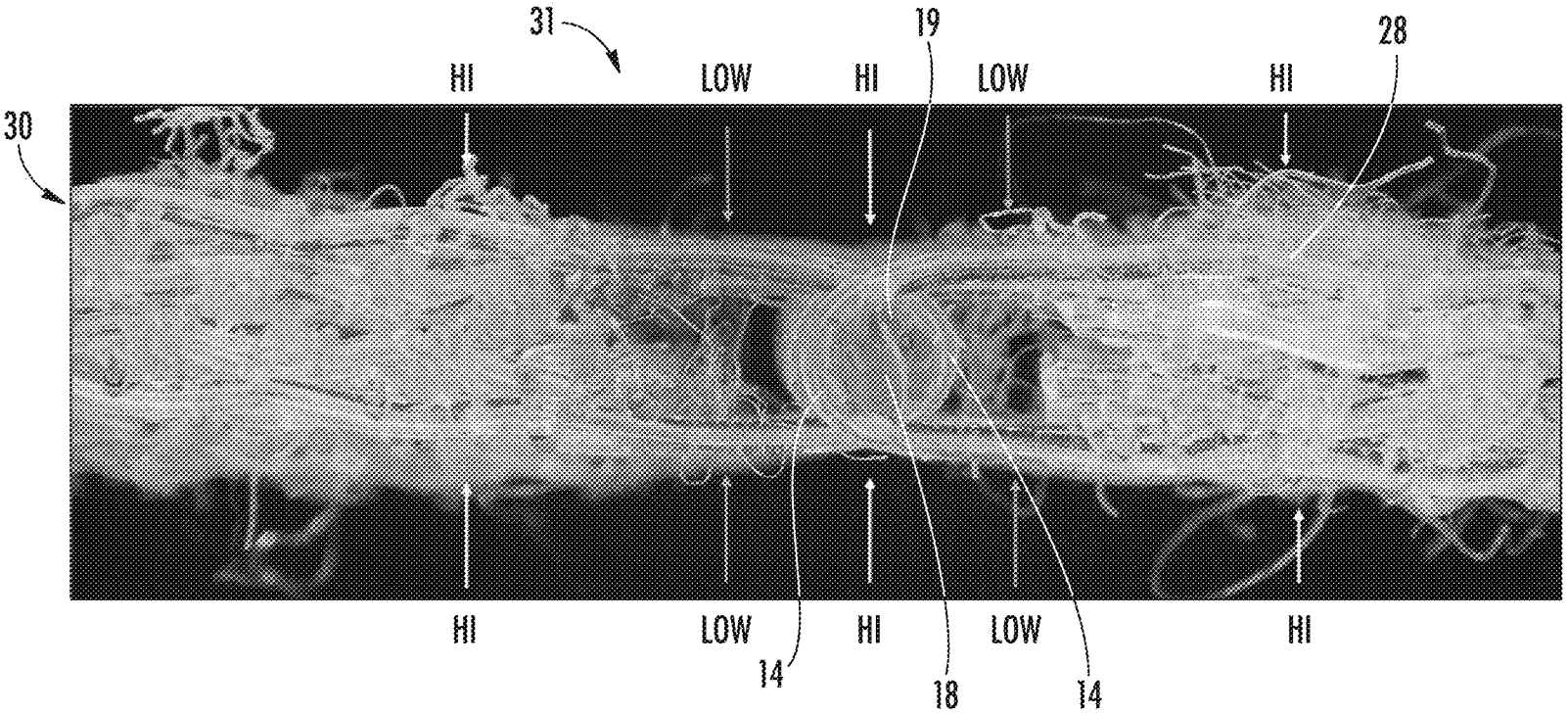
FIG. 5 PRIOR ART
FIG. 5 is a photograph through the seam region of a press felt 31 formed from the base fabric 30 according to the prior art, with high and low pressure points marked. Here the pintle 19 is formed by a cabled yarn.

FIG. 5 shows a cross-section of the press felt 31 in the area of the seam loops 14 with the needled batt 28 connected to the base fabric 30. In this sample, the pintle 18 is formed as a cabled yarn having multiple monofilaments. As indicated by the arrows in FIG. 5, as the press felt 31 passes through the nip between press rolls, areas of low and high pressure are formed based on the void areas in the press felt 31. Specifically, low pressure areas are formed in the seam region adjacent to the pintle channel 19 through which the pintle 18 is inserted. As discussed above, one previously known method for attempting to normalize this area is to provide stuffer yarns, which are small multifilament yarns intended to allow better engagement and entanglement of the batt fibers in the seam region. However, as discussed below, this still does not adequately address these low pressure regions sufficiently to avoid sheet marking in the seam region which not only results in marking of the paper product produced, but can result in web tears due to the lower tensile strength of the web being formed in the area of the marking.

Figure 6:
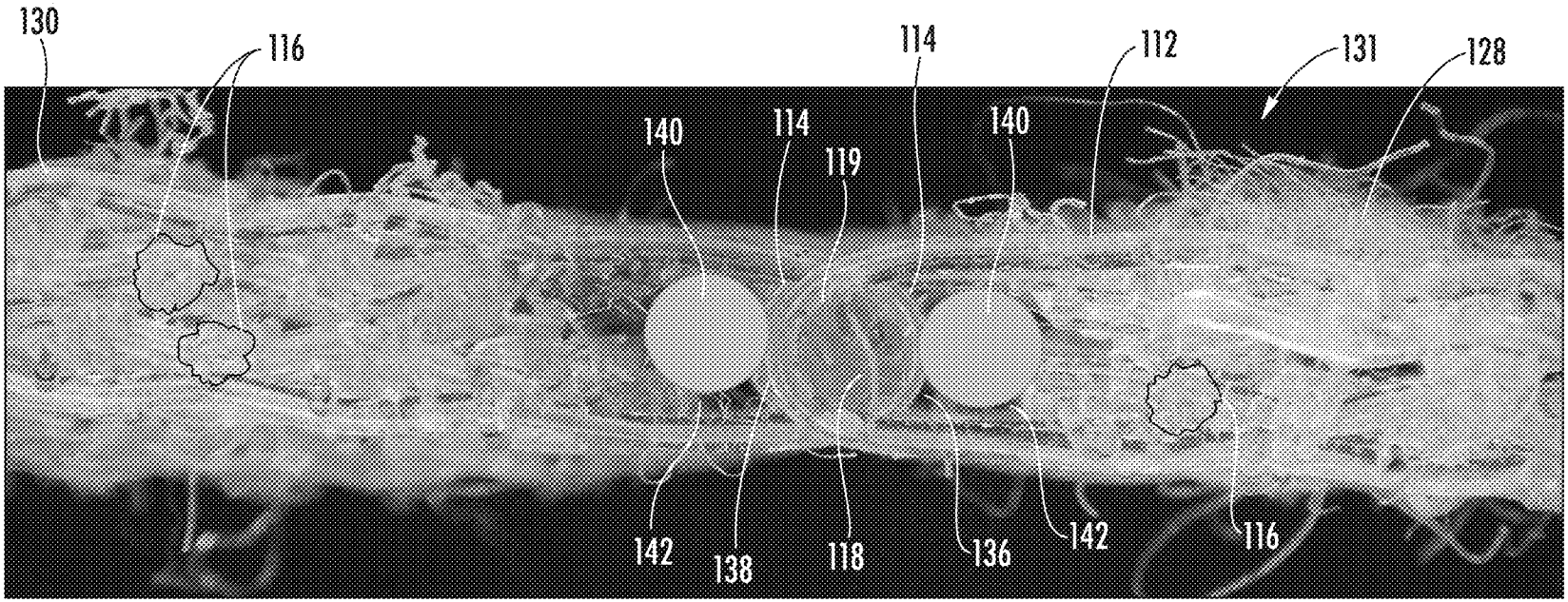
FIG. 6 is a cross-section through a seamed fabric having a seam region with a single monofilament support yarn on each side of the pintle channel in accordance with an embodiment of the invention.

FIG. 6 shows a first embodiment of a press felt 131 formed with a base fabric 130 having a seam region in accordance with the invention. The press felt base fabric 130 is similar to the prior art base fabric 30 discussed above and can be formed by any of the methods noted, and includes MD oriented yarns 112, with MD loops 114 formed at the fabric ends 136, 138, CD oriented yarns 116, as well as a pintle 118 that joins the intermeshed MD loops 114 from the two fabric ends 136, 138 by being inserted through the pintle channel 119 formed by the intermeshed MD loops 114. One or more layers of batt fiber material 128 are needled through the base fabric 130 to form the press felt 131. In this case, the base fabric 130 has a CD width and an MD length similar to the prior art fabric 30 and the two opposing MD ends 136, 138 are joined to form a continuous belt. As shown in FIG. 6, loop open spaces 142 are located within the loops 114 on each of the two opposing MD ends 136, 138 in the seam region. The loop open spaces 142 are defined between a last one of the CD yarns 116 at each of the two opposing MD ends 136, 138 and the pintle channel 119. In accordance with the invention, at least one CD monofilament support yarn 140 is located in the loop open spaces 142 on each of the opposing MD ends 136, 138. Preferably the number of CD monofilament support yarns 140 in each of the loop open spaces is no more than 5, and more preferably, no more than 2. The CD monofilament support yarns 140 have a diameter $D_{support}$ that is at least 1.6 times a diameter $D_{cd}$ of the CD oriented yarns 116.

In the embodiment shown in FIG. 6, the CD oriented yarns 116 are alternating multifilament yarns and monofilament yarns. The greater of the overall diameter of the multifilament CD yarn or CD monofilament yarn is used for $D_{cd}$. In other embodiments where all the CD oriented yarns 116 are monofilaments, the diameter $D_{cd}$ is of the monofilament. As FIG. 6 is an enlarged photograph of an actual sample press felt 130 and the batt fiber material 128 has been needled through the fabric structure, these CD multifilament yarns are not all specifically bundled based on the separation caused by the needling. Preferably, as shown in FIG. 6, only a single one of the CD monofilament support yarns 140 is used in the loop open spaces 142 on each of the two opposing MD ends 136, 138. The diameter $D_{support}$ of the CD monofilament support yarns 140 is at least three times the diameter $D_{cd}$ of the CD oriented yarns 116. Preferably, the diameter $D_{support}$ of the CD monofilament support yarns 140 is no more than seven times a diameter $D_{cd}$ of the CD oriented yarns 112.

Figure 8:
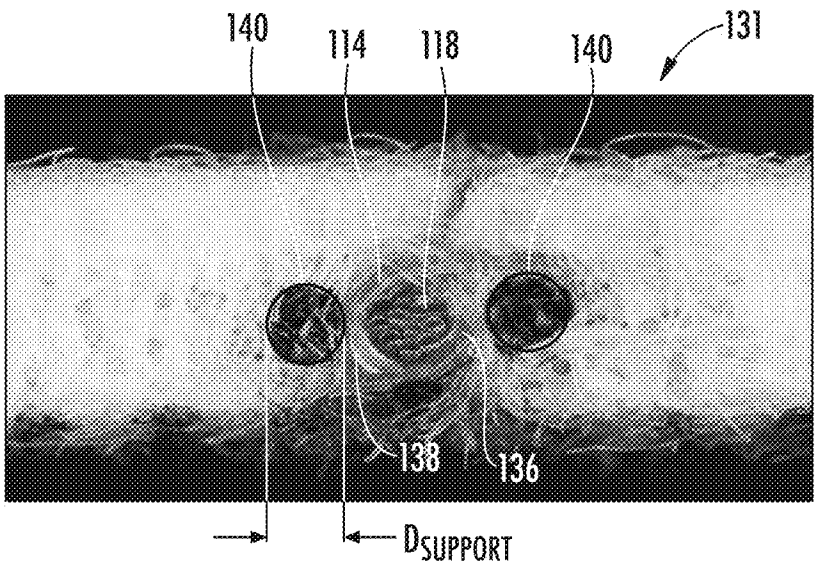
FIG. 8 is a photograph through the seam region of an actual base fabric with a single monofilament support yarn on each side of the pintle channel in accordance with an embodiment of the invention.
Figure 7:
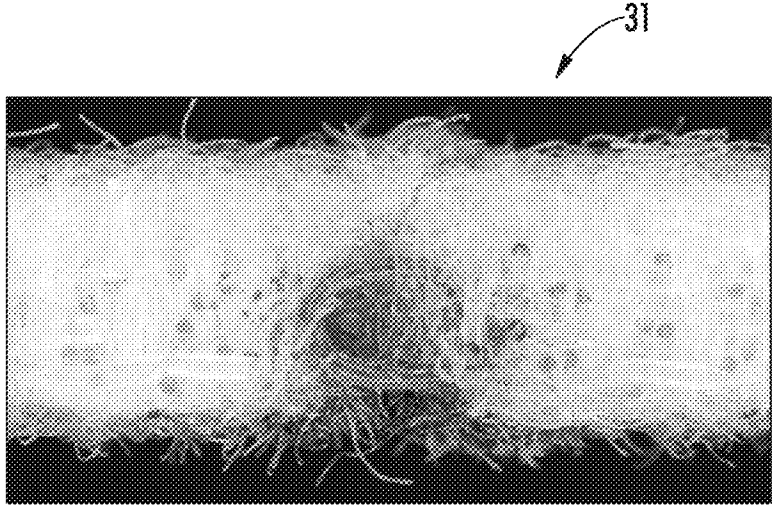
FIG. 7 PRIOR ART
FIG. 7 is a photograph through the seam region of an actual base fabric 30 according to the prior art.
Figure 9:
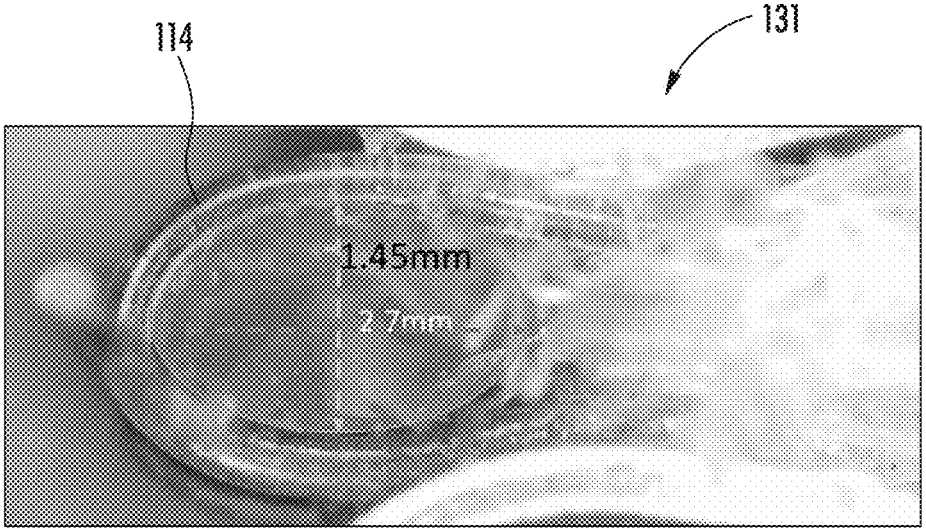
FIG. 9 is a photograph of a single seam loop on an end of the base fabric showing the seam loop dimensions used for actual testing of a prior art control fabric and test fabrics according to the invention.

Referring to FIGS. 7 and 8, FIG. 7 shows a control sample of the prior art press felt 31 while FIG. 8 shows the press felt base fabric 131 in accordance with an embodiment of the present invention with a single CD monofilament support yarn 140 located in each of the loop open spaces 142 on the two opposing ends 136, 138. FIG. 7 shows the prior art arrangement having the same weave construction of the base fabric 30 as the base fabric 130 used for the invention, with the difference being that a multifilament stuffer was used in the seam region at the loop open spaces outside of the pintle channel 19. FIG. 9 shows this construction with the batt removed from the seam loop 114 and in both cases, the void area of the seam loop in total is 3.05 $mm^2$. In accordance with the prior art arrangement the percentage fill was 13.9%. In accordance with the embodiment shown in FIGS. 6 and 8 with the same size pintle and the use of a single 1.0 mm diameter CD monofilament support yarn 140, this raises the percentage fill to 39.6%. The same embodiment in accordance with the invention in which the single CD monofilament support yarn 140 has a diameter of 1.5 mm, results in a percentage fill of 71.7% of the void area.

The monofilament CD support yarns 140 prevent the collapse of the MD loops 114 that form the pintle channel 119 and also reduce the elongation of the loops 114 by filling a greater percentage of the loop void area. Further, based on the increased fill provided by the CD monofilament support yarns 140, the air permeability as well as the pressure become more uniform in the region of the seam, resulting in less seam marking.

Figure 10A:
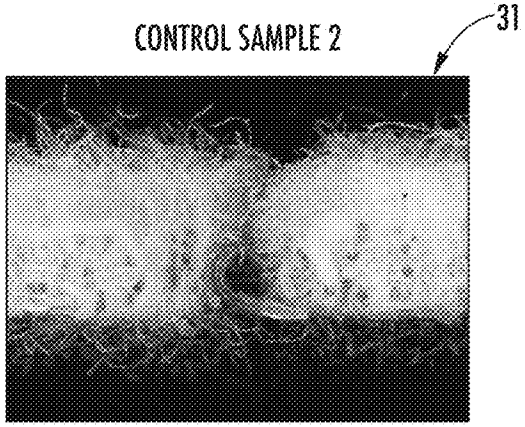
FIGS. 10A-10C show photographs through the seam region of a prior art Control Sample which includes a multifilament stuffer yarn on each side of the pintle channel (FIG. 10A) and Trial Samples 1 and 2 with a single monofilament support yarn on each side of the pintle channel according to the invention (FIGS. 10B and 10C).
Figure 10B:
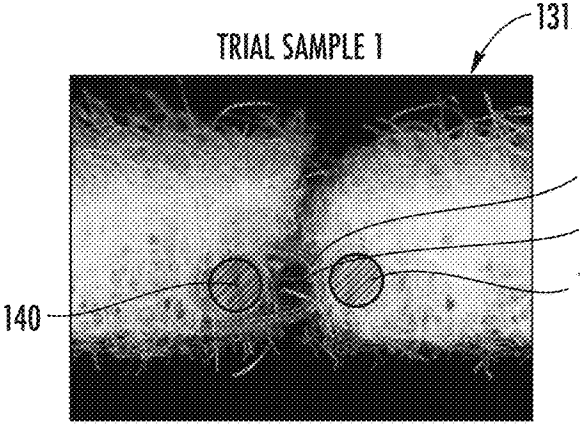
Figure 10C:
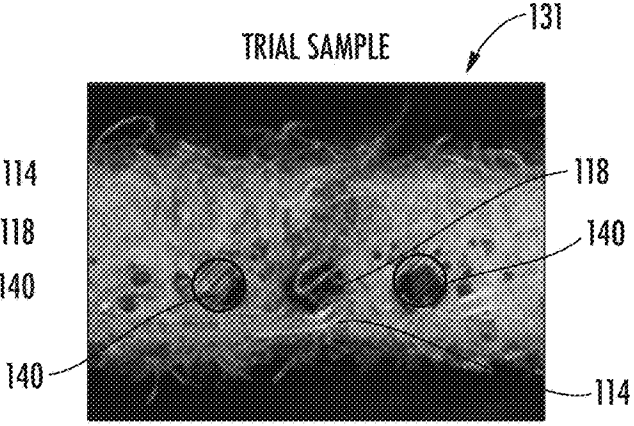
Figure 11C:
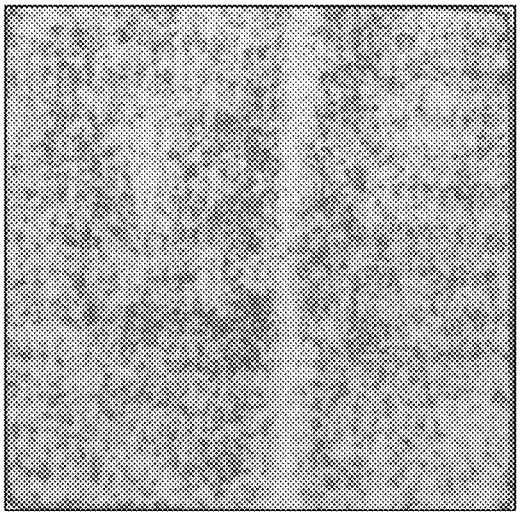
FIGS. 11A-11C show photographs of an imprinted paper sample from the seam region formed on the Control Sample (FIG. 11A) and Trial Samples 1 and 2 (FIGS. 11B and 11C) according to the invention and illustrate the reduction of the low pressure areas in the seam regions of Trial Samples 1 and 2 in comparison to the Control Sample.
Figure 11B:
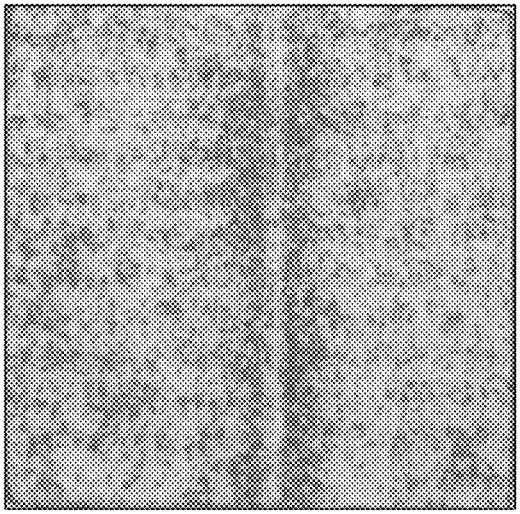
Figure 11A:
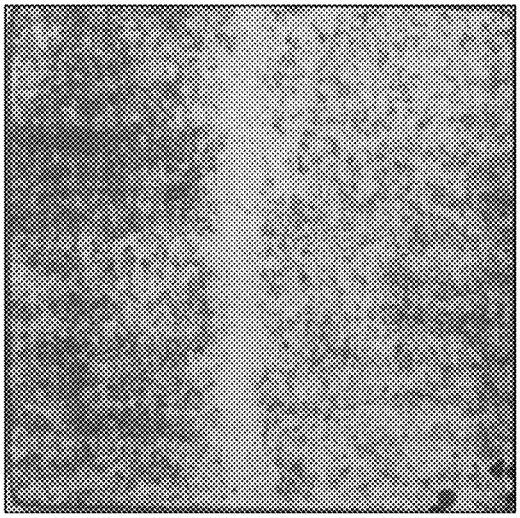

Referring to FIGS. 10A-10C, a control sample of a press felt 31 as well as trial samples 1 and 2 of the press felt 131 are shown in the seam area. The control sample is in accordance with the known prior art utilizing a multifilament stuffer yarn in the loop open spaces while trial sample 1 utilizes a single CD monofilament support yarn 140 having a diameter $D_{support}$ of 1.75 mm in the loop open spaces on each of the two opposing MD ends 136, 138. Trial sample 2 utilizes a single CD monofilament support yarn 140 having a diameter $D_{support}$ of 1.0 mm in each of the loop open spaces 142 on the two opposing ends 136, 138. The ratio of the overall diameter of the prior art stuffer yarns used in the control sample to the diameter of the CD yarns: $D_{stuff}/D_{cd}$=0.5, while the ratio in trial sample 1 is $D_{support}/D_{cd}$=5.8 and in trial sample 2 is $D_{support}/D_{cd}$=3.3. These samples were run in a pilot papermaking machine and a press sensitive film was inserted into the nip in the seam area when the samples pass through the nip. The resulted imprinting on each of these samples in the seam region is shown in FIGS. 11A-11C, respectively. As can be seen from the control sample, there is a large white/light area (low pressure area) in the seam region. However, for both trial sample 1 and trial sample 2, this white/light area is reduced by 50% or more in trial sample 1 and by 75% or more in trial sample 2.

Figure 12A:
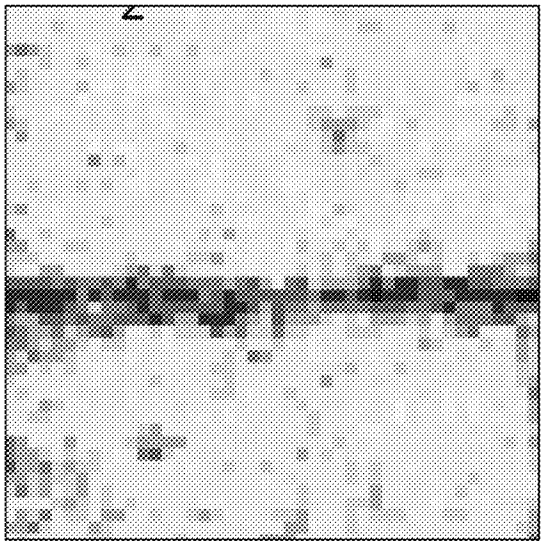
FIGS. 12A-12C show seam quality index graphs that indicate high and low pressure regions in the seam region for the Control Sample (FIG. 12A) and Trial Samples 1 and 2 (FIGS. 12B and 12C). The seam quality index graphs show a visible improvement in the reduction of low pressure areas in the seam regions of Trial Samples 1 and 2 in comparison to the Control Sample, and the calculated seam quality index which indicates the potential for sheet marking also improved from the Control Sample (SQI=4.2) to Trial Sample 1 (SQI=2.2) and Trial Sample 2 (SQI=3.2).
Figure 12B:
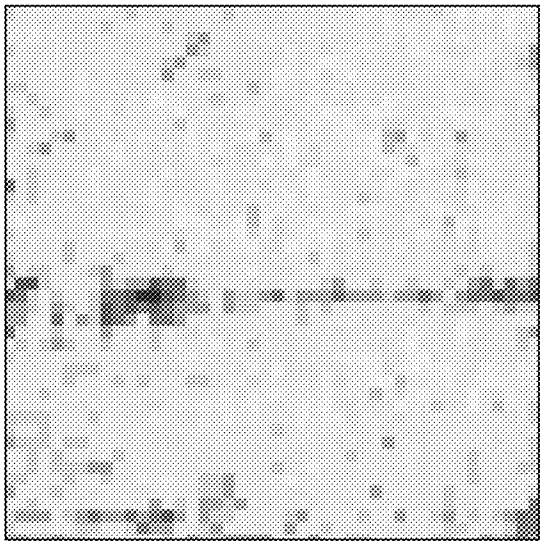
Figure 12C:
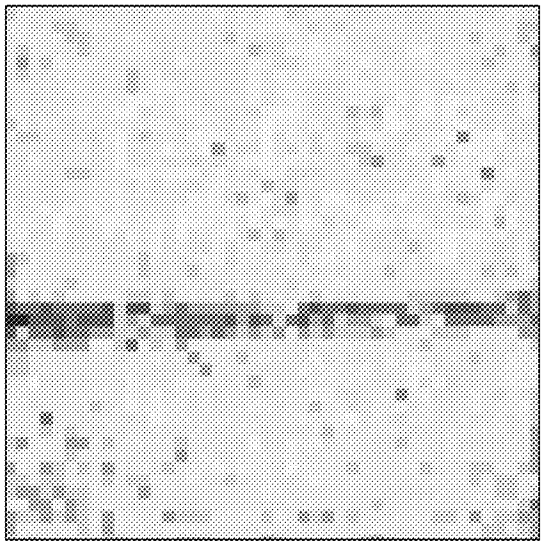

With respect to FIGS. 12A-12C, an analysis was performed to test the seam quality index of the control sample in the seam region as well as trial samples 1 and 2 in the seam region. The seam quality index in the control sample was 4.2 while in trial sample 1, the seam quality index improved to 2.2 and in trial sample 2 it improved to 3.2. The graphs in FIGS. 12A-12C are a direct measurement of pressure uniformity over the seam area and the dark area (blue in the color photos) indicates a low pressure area while the lighter areas represent the higher pressure areas. The index is based on a width and degree of the low pressure areas. This seam quality index is an indicator of potential to mark the sheet being carried by the press felt 131 and the lower index means that there is less potential for sheet marking.

Figure 13A:
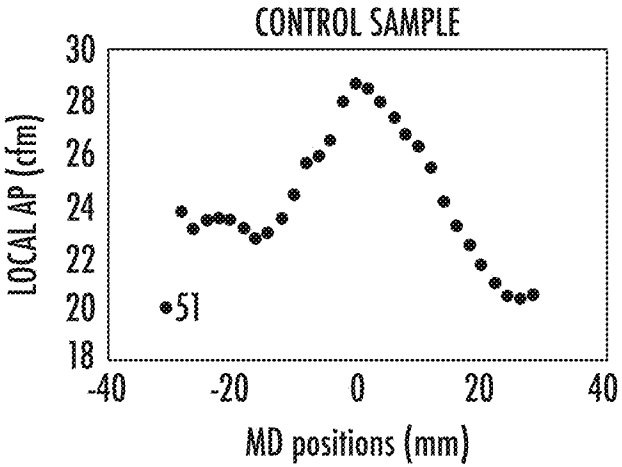
FIGS. 13A-13 C provide graphs showing the air permeability change across the seam regions for the Control Sample (FIG. 13A) and Trial Samples 1 and 2 (FIGS. 13B and 13C).
Figure 13B:
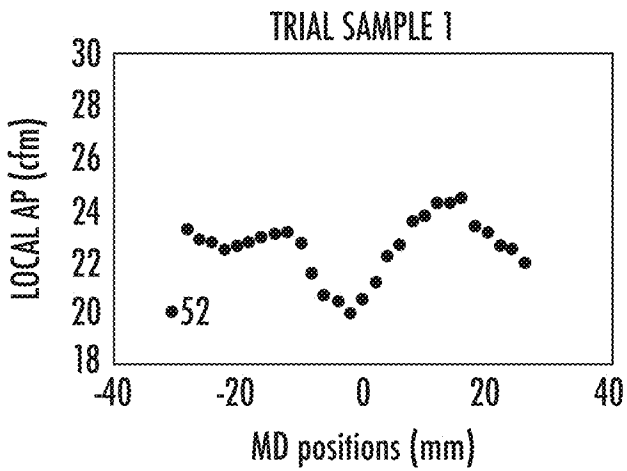
Figure 13C:
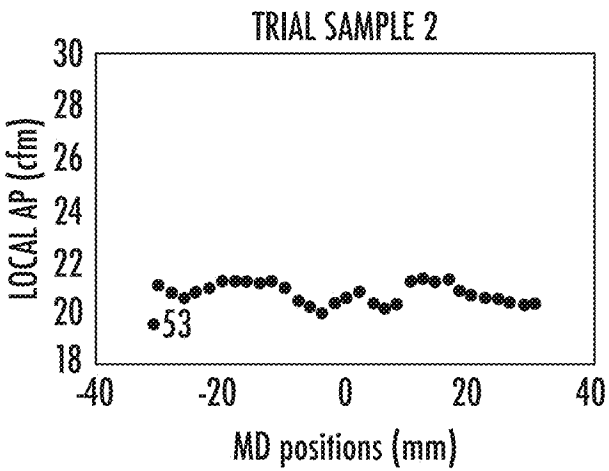
Figure 14A:
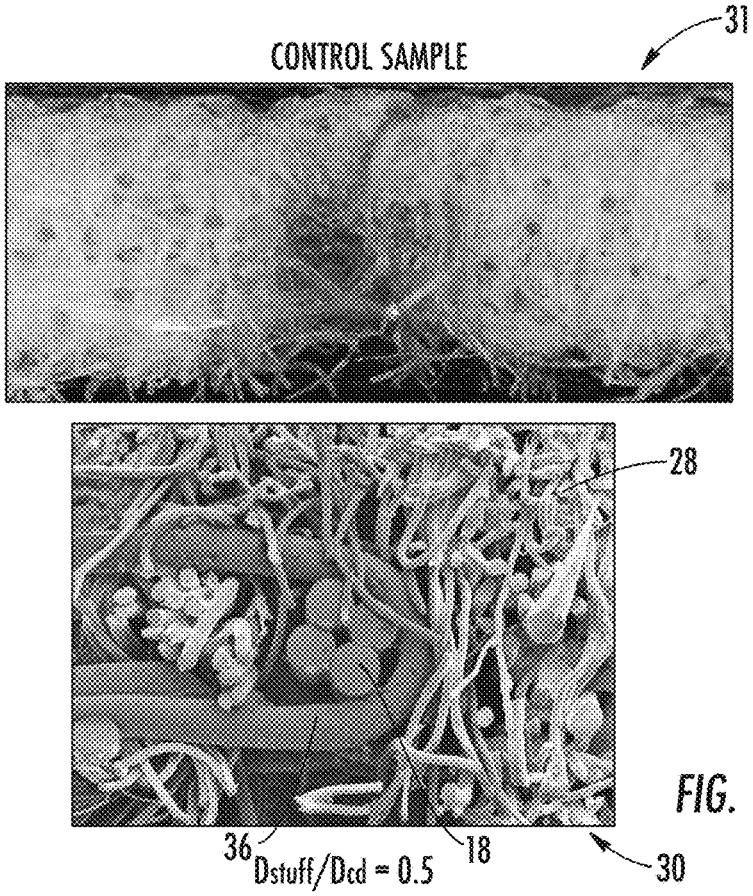
FIGS. 14A and 14B show photographs through the seam region of another prior art Control Sample which includes a multifilament stuffer yarn on each side of the pintle channel (FIG. 14A) and Trial Sample 3 with two monofilament support yarns on each side of the pintle channel according to the invention (FIG. 14B).
Figure 14B:
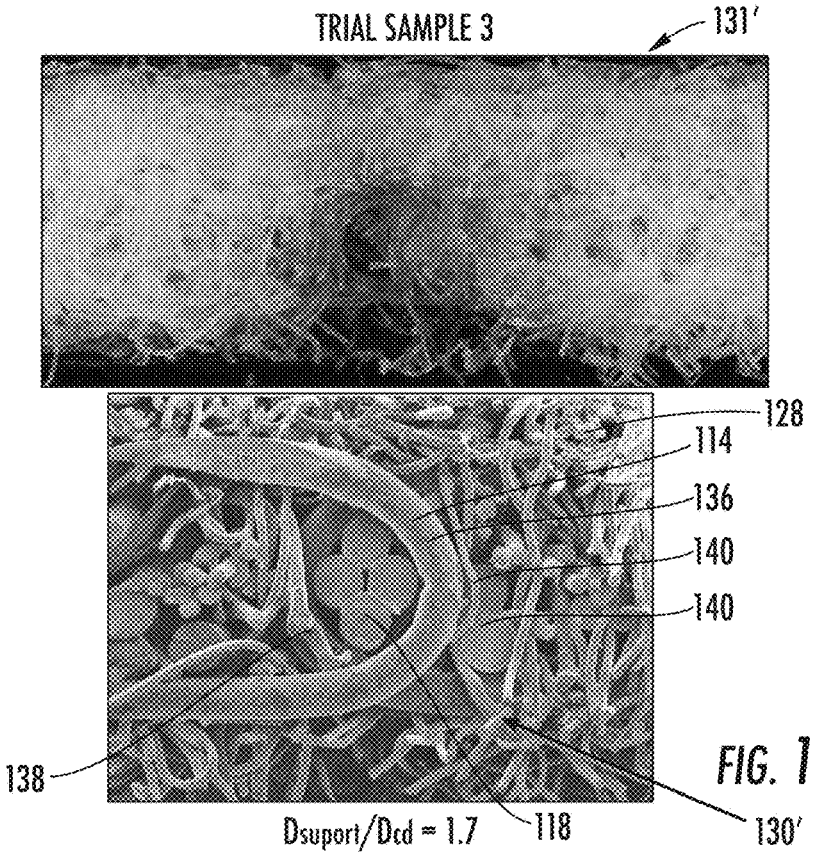
Figure 15B:
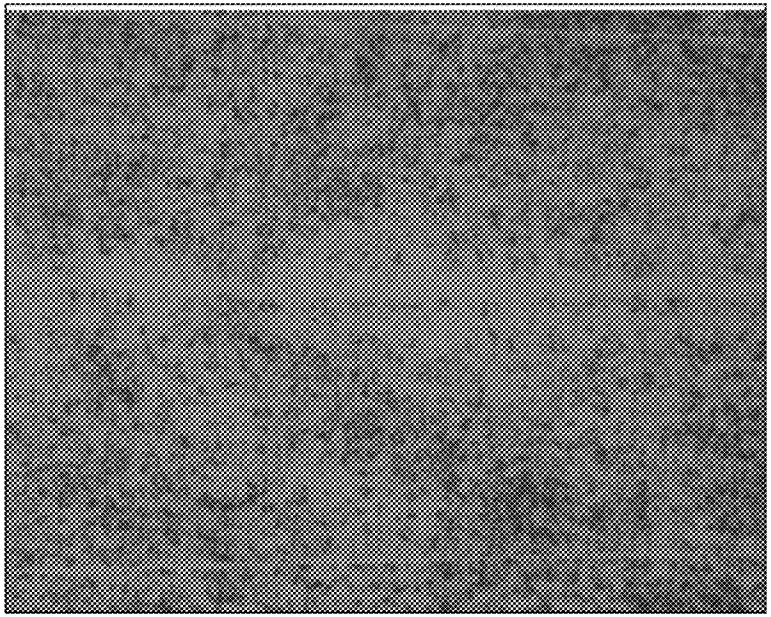
FIGS. 15A and 15B shows photographs of an imprinted paper sample from the seam region formed on the Control Sample (FIG. 15A) and Trial Sample 3 (FIG. 15B) according to the invention and illustrates the reduction of the low pressure areas in the seam regions of Trial Sample 3 in comparison to the Control Sample.
Figure 15A:
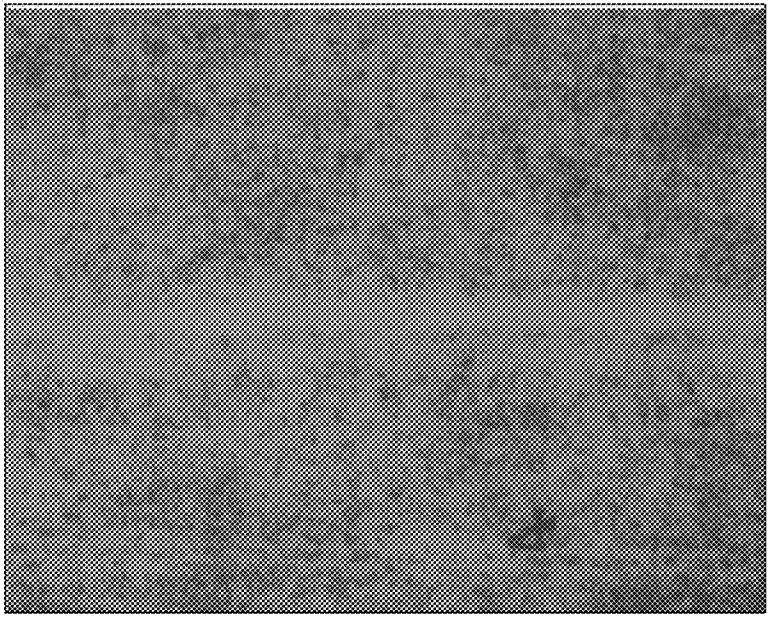

FIGS. 13A-13C show an air permeability test across the seam region for the control sample as well as trial samples 1 and 2. Here it can be seen that there is a large variation in the air permeability in the control sample while in trial sample 1 the variability in air permeability across the seam region is less than about 15% in comparison to the air permeability of the press felt outside of the seam region based on the measured cubic feet per minute of air flow through the seam region at different MD positions. Trial sample 2 resulted in a much more uniform air permeability across the seam region with the variation in air permeability of less than about 10% across the seam region in comparison to the air permeability of the press felt outside of the seam region. This is due to the CD monofilament support yarns 140 filling at least 25%, more preferably at least 39%, and most preferably at least 50% of the total area of the loops 114 in comparison with the prior art only filling about 13% of the area.

Depending on the configuration of whether a single CD monofilament support yarn 140 is located in the loop open space 142 on each side of the two opposing MD ends 136, 138 or whether two of the CD monofilament support yarns 140 are located in the loop open space 142 on each side of the two opposing MD ends 136, 138, the fill ratio can be up to about 70% or more. Those skilled in the art will recognize that the diameter $D_{support}$ of the CD monofilament support yarns 140 may vary, but in the preferred embodiments, sizes of 0.5 mm, 1.0 mm, and 1.75 mm have proven to provide the benefits noted above.

Referring now to FIGS. 14A, 14B, and 15-17, an alternate embodiment of the press felt 131' was tested against a control sample. In this alternate embodiment a press felt base fabric 130' similar to the press felt base fabric 130 or 30 is used, and two of the CD monofilament support yarns 140 were located in the loop open spaces 142 on each of the two opposing MD ends 136, 138 of the press felt 131' along with a multifilament stuffer yarn. In this case, the ratio of the diameter of the CD support yarns versus the CD yarns of the base fabric was $D_{support}/D_{cd}$=1.7. This was over three times greater than the ratio in the control sample according to the prior art where $D_{stuff}/D_{cd}$=0.5. The press felt 131' used for a trial sample 3 as well as the control sample were run on a test machine and the paper web in the seam area was imprinted to show the low pressure areas (white/light areas) in FIGS. 15A and 15B. In this case, the white/light areas in the control sample are much more noticeable than in the web from the seam region of trial sample 3.

Figure 16B:
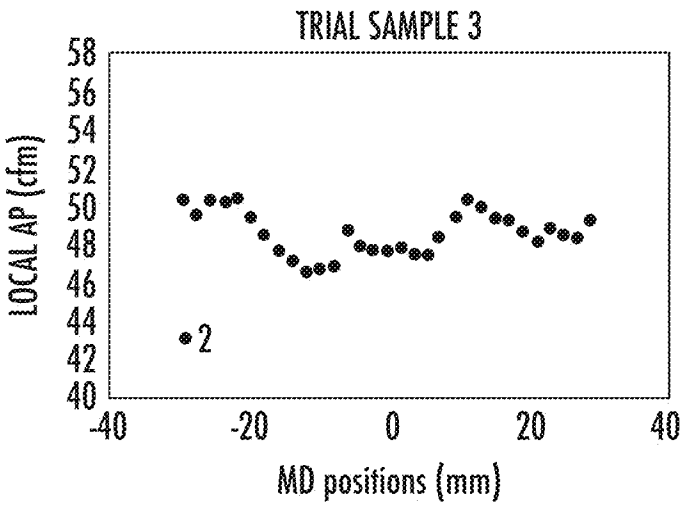
FIGS. 16A and 16B provides graphs showing the air permeability change across the seam regions for the Control Sample (FIG. 16A) and Trial Sample 3 (FIG. 16B).
Figure 16A:
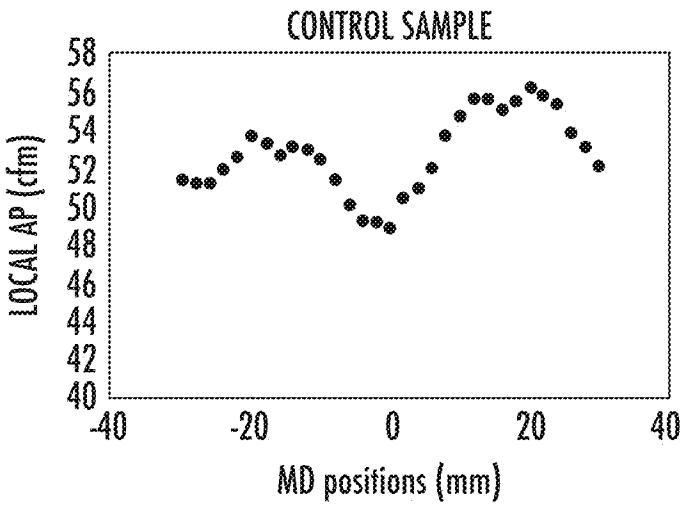

FIGS. 16A and 16B show the air permeability across the seam region. The air permeability of trial sample 3 across the seam region was much more uniform in comparison to the control sample, being within about 10% of the air permeability of the press felt outside of the seam region.

Figure 17B:
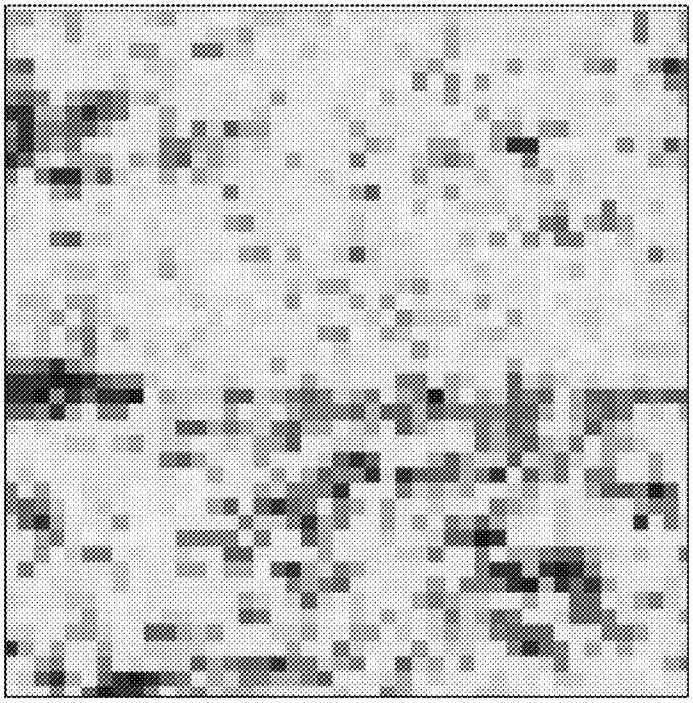
FIGS. 17A and 17B shows seam quality index graphs that indicate high and low pressure regions in the seam region for the Control Sample (FIG. 17A) and Trial Sample 3 (FIG. 17 B). The seam quality index graphs show a visible improvement in the reduction of low pressure areas in the seam region of Trial Sample 3 in comparison to the Control Sample, and the calculated seam quality index which indicates the potential for sheet marking also improved from the Control Sample (SQI=3.2) to Trial Sample 3 (SQI=1.6).
Figure 17A:
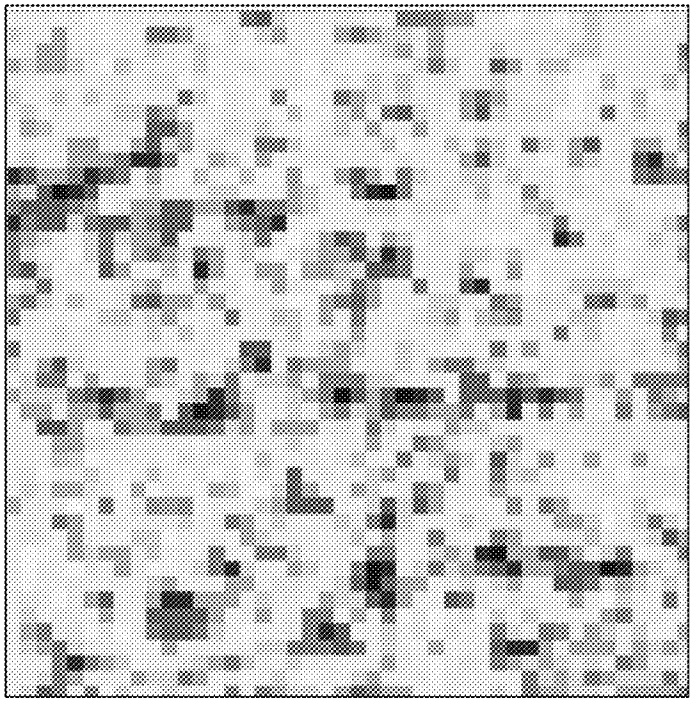

FIGS. 17A and 17B show the seam quality index for the control sample versus trial sample 3. Here there was an improvement in the seam quality index from 3.2 in the control sample to 1.6 in the trial sample. This indicates that there is a much lower potential for sheet marking in the seam area of the seamed press felt 131' in accordance with this embodiment.

In the preferred embodiments, both the MD yarns 112 and the CD yarns 116 are preferably polyamide monofilaments or cabled yarns. These can be formed of polyamide-6/10 or any other suitable polyamides or co-polymers thereof. Monofilaments formed of polyurethane polymers could also be used. The CD monofilament support yarns are preferably polyurethane. However, other suitable polyamides or co-polymers thereof could be used.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

The invention claimed is:

1. A seamed press felt comprising:

a multiaxial base fabric having a CD width and a MD length with two opposing MD ends that are joined to form a continuous belt;

MD oriented yarns form uniform loops at the two opposing MD ends that are interdigitated to define a pintle channel extending the CD width;

CD oriented yarns connected to the MD oriented yarns;

loop open spaces located within the loops on each of the two opposing MD ends in a seam region, the loop open spaces being defined between a last one of the CD yarns at each of the two opposing MD ends and the pintle channel;

at least one CD monofilament support yarn located in the loop open spaces on each of the two opposing MD ends, the at least one CD monofilament support yarn having a diameter that is at least 3 times a diameter of the CD oriented yarns and no more than 7 times the diameter of the CD oriented yarns, and filling at least 25% of a total area of the respective loops;

a pintle extending through the pintle channel to form a seam; and wherein a width and degree of low pressure areas in the seam region is reduced by 50% or more in comparison to a control sample of a press felt having a same construction except for the at least one CD monofilament support yarn having a same or lesser diameter than the CD oriented yarns.

2. The press felt according to claim 1, wherein a single one of the CD monofilament support yarns is used in the loop open spaces on each of the two opposing MD ends.

3. The press felt according to claim 1, wherein no more than two of the CD monofilament support yarns are used in the loop open spaces on each of the two opposing MD ends.

4. The press felt according to claim 1, wherein two of the CD monofilament support yarns are used in the loop open spaces on each of the two opposing MD ends.

5. The press felt according to claim 4, wherein the diameter of the CD monofilament support yarns is no more than 4 times a diameter of the CD oriented yarns.

6. The press felt according to claim 1, further comprising batt fibers needled to the base fabric.

7. The press felt according to claim 1, wherein an air permeability of the press felt across the seam region is within 15% of an air permeability of the press felt outside of the seam region.

8. The press felt according to claim 1, wherein an air permeability of the press felt across the seam region is within 10% of an air permeability of the press felt outside of the seam region.

9. The press felt according to claim 1, wherein the at least one CD monofilament support yarn fills at least 39% of a total area of the loops.

10. The press felt according to claim 1, wherein the base fabric is woven.

11. The press felt according to claim 1, wherein the base fabric is non-woven.

12. The press felt according to claim 1, wherein the at least one CD monofilament support yarn has a diameter of at least 0.5 mm.

13. The press felt according to claim 1, wherein the at least one CD monofilament support yarn has a diameter of at least 1.0 mm.

14. The press felt according to claim 1, wherein the at least one CD monofilament support yarn is made of polyurethane.

* * * * *